US008339321B2

(12) United States Patent
Nagano et al.

(10) Patent No.: US 8,339,321 B2
(45) Date of Patent: Dec. 25, 2012

(54) ANTENNA DEVICE AND PORTABLE RADIO APPARATUS

(75) Inventors: Kenya Nagano, Sendai (JP); Yoshio Koyanagi, Yokohama (JP)

(73) Assignee: Panasonic Corporation, Osaka (JP)

( * ) Notice: Subject to any disclaimer, the term of this patent is extended or adjusted under 35 U.S.C. 154(b) by 361 days.

(21) Appl. No.: 12/671,907

(22) PCT Filed: Aug. 9, 2007

(86) PCT No.: PCT/JP2007/065614
§ 371 (c)(1),
(2), (4) Date: Feb. 2, 2010

(87) PCT Pub. No.: WO2009/019782
PCT Pub. Date: Feb. 12, 2009

(65) Prior Publication Data

US 2011/0057857 A1 Mar. 10, 2011

(51) Int. Cl.
*H01Q 1/24* (2006.01)

(52) U.S. Cl. ..... 343/702; 343/876

(58) Field of Classification Search ..... 343/702, 343/876; 455/73, 78, 101, 552.1
See application file for complete search history.

(56) References Cited

U.S. PATENT DOCUMENTS

| | | | | |
|---|---|---|---|---|
| 5,822,684 | A * | 10/1998 | Kitakubo | 455/78 |
| 7,092,678 | B2 * | 8/2006 | Shih | 455/78 |
| 7,127,269 | B2 * | 10/2006 | Shih | 455/552.1 |
| 7,263,147 | B2 * | 8/2007 | Li et al. | 375/347 |

FOREIGN PATENT DOCUMENTS

| | | | |
|---|---|---|---|
| JP | 2002-232224 | A | 8/2002 |
| JP | 2004-040154 | A | 2/2004 |
| JP | 2004-072605 | A | 3/2004 |
| JP | 2004-274445 | A | 9/2004 |
| JP | 2005-020228 | A | 1/2005 |
| JP | 2005-260762 | A | 9/2005 |
| JP | 2005-269301 | A | 9/2005 |

OTHER PUBLICATIONS

International Search Report mailed Sep. 25, 2007, in corresponding International Application No. PCT/JP2007/065614, filed Aug. 9, 2007.

* cited by examiner

*Primary Examiner* — Hoang V Nguyen
(74) *Attorney, Agent, or Firm* — Seed IP Law Group PLLC

(57) ABSTRACT

A small antenna system which is incorporated in a portable radio apparatus and can ensure high antenna performance in a wide frequency band without impairing the design property or the operability and a portable radio apparatus are provided. An antenna device includes an antenna A1 having a resonance characteristic in a first frequency; an antenna A2 having a resonance characteristic in a second frequency and being spaced from the antenna A1 at a predetermined distance; a circuit board P provided in a mobile telephone 10, a wireless section 16 provided on the circuit board P for supplying or receiving high-frequency power; and a high-frequency switch 13 provided on the circuit board P for selecting connection of an output terminal or an input terminal of the wireless section 16 and a feeding point of the antenna A1 or the antenna A2 so that the feeding point of the antenna A1 or the antenna A2 can be switched and connecting to the wireless section 16.

10 Claims, 5 Drawing Sheets

ANTENNA DEVICE AND PORTABLE RADIO APPARATUS

TECHNICAL FIELD

This invention relates to an antenna device and in particular to an antenna device provided in a portable radio apparatus and a portable radio apparatus including the antenna device.

BACKGROUND ART

In recent years, a portable radio apparatus typified by a mobile telephone has expanded in functionality as multiple functions and an apparatus installing functions other than telephone communication functions, such as a digital TV broadcast reception function and a GPS (Global Positioning System) function, (which will be hereinafter referred to as "multifunctional portable radio apparatus") has become widespread. Of such multifunctional portable radio apparatuses, an apparatus installing the digital TV broadcast reception function requires a wide-band antenna system covering a continuous wide digital TV broadcast frequency band (470 MHz to 770 MHz: Ratio band 48%). An apparatus installing other various communication functions (which will be hereinafter referred to as "applications") than telephone communication functions requires a wide-band antenna system operating covering the operation frequency of each of the applications.

By the way, as a wide-band antenna system installed in a conventional portable radio apparatus, an antenna system of the configuration wherein a passive element is placed in the proximity of an antenna element is known (for example, refer to Patent Document 1). An antenna system of the configuration wherein a passive element connected to ground becoming a ground plate of an antenna element is placed in the proximity of the antenna element is also known (for example, refer to Patent Document 2).

In the antenna systems described above, the two elements of the antenna element and the passive element are used and high antenna performance can be ensured at the resonance frequency of each of the two elements and thus a wider band can be provided as compared with the case where the number of antenna elements is one.

Patent Document 1: JP-A-2005-20228
Patent Document 2: JP-A-2004-40154

DISCLOSURE OF THE INVENTION

Problems to be Solved by the Invention

However, to use the antenna system compatible with two resonance frequencies using the two elements installed in the portable radio apparatus for digital TV broadcast reception, metal components of hinge metal, a camera, a battery, a board pattern, etc., installed in the portable radio apparatus and the antenna element are brought close to each other. Thus, the radiation resistance of the antenna lowers, the frequency bandwidth obtained from each element becomes narrow, and high antenna performance cannot be ensured in all frequency bands required for digital TV broadcast reception; this is a problem. There is also a problem in that if the distance between the antenna element and the metal components installed in the portable radio apparatus is increased for a wider band, the device is upsized and the design property and the operability are impaired.

In the antenna having low radiation resistance placed in the mobile telephone as in the antenna system, resonance obtained with one antenna is one with a narrow frequency band. Thus, to use the antenna system as an antenna system for a plurality of applications, resonance in a larger number of types of frequency bands than the number of antenna elements cannot be obtained and thus the antenna system can be used only as an antenna for the wireless system responsive to the number of antenna elements; this is a problem.

In view of the circumstances described above, it is an object of the invention to provide an antenna device that can be downsized and can ensure high antenna performance in a wide frequency band without impairing the design property or the operability and a portable radio apparatus.

Means for Solving the Problems

An antenna device of the invention includes a first antenna element having a resonance characteristic in a first frequency; a second antenna element having a resonance characteristic in a second frequency and being spaced from the first antenna element at a predetermined distance; a wireless circuit section for supplying or receiving high-frequency power; and a switch section for selectively connecting an output terminal or an input terminal of the wireless circuit section and a feeding point of the first antenna element or the second antenna element, so as to switch and connect the wireless circuit section and either one of the first antenna element and the second antenna element. The second antenna element has an antenna effective length made shorter than an antenna effective length of the first antenna element, and when the switch section connects the wireless circuit section and the feeding point of the second antenna element and power is transmitted or received from the second antenna, the first antenna element operates as a passive element of the second antenna element, whereby the frequency characteristic of the second antenna element has a resonance characteristic in a vicinity of the second frequency and a third frequency higher than the second frequency.

According to the configuration, the three frequency bands can be covered using the two antenna elements, so that a wider band is made possible and only the two antenna elements need to be provided as antenna elements and the antenna device can be downsized and the design property and the operability are not impaired.

In the antenna device of the invention, the length of the first antenna element is about a quarter-wavelength of the first frequency and the length of the second antenna element is about a quarter-wavelength of the second frequency.

According to the configuration, the three frequency bands can be covered using the two antenna elements, so that a wider band can be provided and high antenna performance can be ensured.

In the antenna device of the invention, the length of the first antenna element is about a half-wavelength of the third frequency.

According to the configuration, the three frequency bands can also be covered using the two antenna elements, so that a wider band can be provided and high antenna performance can be ensured.

In the antenna device of the invention, the gap between the first antenna element and the second antenna element is equal to or less than about a quarter-wavelength of the second frequency.

According to the configuration, to feed power into the second antenna element, an antenna current becomes easy to be excited for the first antenna element, so that high antenna performance can be ensured.

In the antenna device of the invention, the first antenna element is disposed on the end part side in the portable radio apparatus from the second antenna element.

According to the configuration, the radio wave of the first frequency has a long wavelength as compared with the radio waves of the second frequency and the third frequency and thus the distance between the first antenna element becoming the radiation source of the first frequency particularly where lowering of radiation resistance needs to be lessened and metal components in the portable radio apparatus can be increased. Consequently, the radiation resistance can be made high and high antenna performance can be ensured.

The antenna device of the invention includes a circuit board and a first reactance element disposed between the switch section provided on the circuit board and a ground pattern of the circuit board. When the first antenna element is connected to the wireless circuit section through the switch section, the second antenna element is connected to the ground pattern of the circuit board through the switch section and the first reactance element.

According to the configuration, to feed power into the first antenna element, degradation of the antenna performance caused as the second antenna element is brought close to the first antenna element and radiation resistance lowers can be suppressed by a reactance element with an appropriate reactance value selected so that the first frequency is not excited in the second antenna element is inserted between the second antenna element and the ground pattern of the circuit board. Consequently, the radiation resistance can be made high and high antenna performance can be ensured.

The antenna device of the invention includes a circuit board and a second reactance element disposed between the switch section provided on the circuit board and a ground pattern of the circuit board. When the second antenna element is connected to the wireless circuit section, the first antenna element is connected to the ground pattern of the circuit board through the second reactance element.

According to the configuration, to feed power into the second antenna element, the reactance value of the second reactance element is changed, whereby the resonance frequency of the first antenna element operating as a passive element can be changed and antenna performance of desired frequency can be improved.

In the antenna device of the invention, the wireless circuit section has three or more wireless circuit sections, and the antenna device includes a first wireless circuit section; a second wireless circuit section having an operation frequency higher than the operation frequency of the first wireless circuit section; a third wireless circuit section having an operation frequency higher than the operation frequency of the second wireless circuit section; a first filter, provided between the switch section and the first wireless circuit section, for attenuating a signal other than the operation frequency of the first wireless circuit section; a second filter, provided between the switch section and the second wireless circuit section, for attenuating a signal other than the operation frequency of the second wireless circuit section; and a third filter, provided between the switch section and the third wireless circuit section, for attenuating a signal other than the operation frequency of the third wireless circuit section.

According to the configuration, a larger number of resonances than the number of antenna elements can be provided, so that operation of a large number of applications than the number of resonances is made possible and the device can be downsized and thus the design property or the operability can be enhanced.

In the antenna device of the invention, a distance between an end part on the switch section side of the first antenna element and an end part on the switch section side of the second antenna element is within a one-eighth wavelength of the second frequency.

According to the configuration, the switch section can be placed in the proximity of both the first antenna element and the second antenna element and it is made unnecessary to long route a line where a high-frequency signal flows between the switch section and the antenna element. Consequently, degradation of a high-frequency signal caused by the line can be lightened, so that high antenna performance can be provided.

A portable radio apparatus of the invention is a portable radio apparatus including the antenna device.

According to the configuration, a portable radio apparatus wherein a small and wide-band antenna system is installed can be provided.

Advantages of the Invention

According to the invention, there can be provided an antenna device that can cover the three frequency bands using the two antenna elements and thus can make a wider band and needs only the two antenna elements as antenna elements and thus can be downsized and can ensure high antenna performance in a wide frequency band without impairing the design property or the operability and a portable radio apparatus including the antenna device.

DESCRIPTION OF REFERENCE NUMERALS

Figure 1:
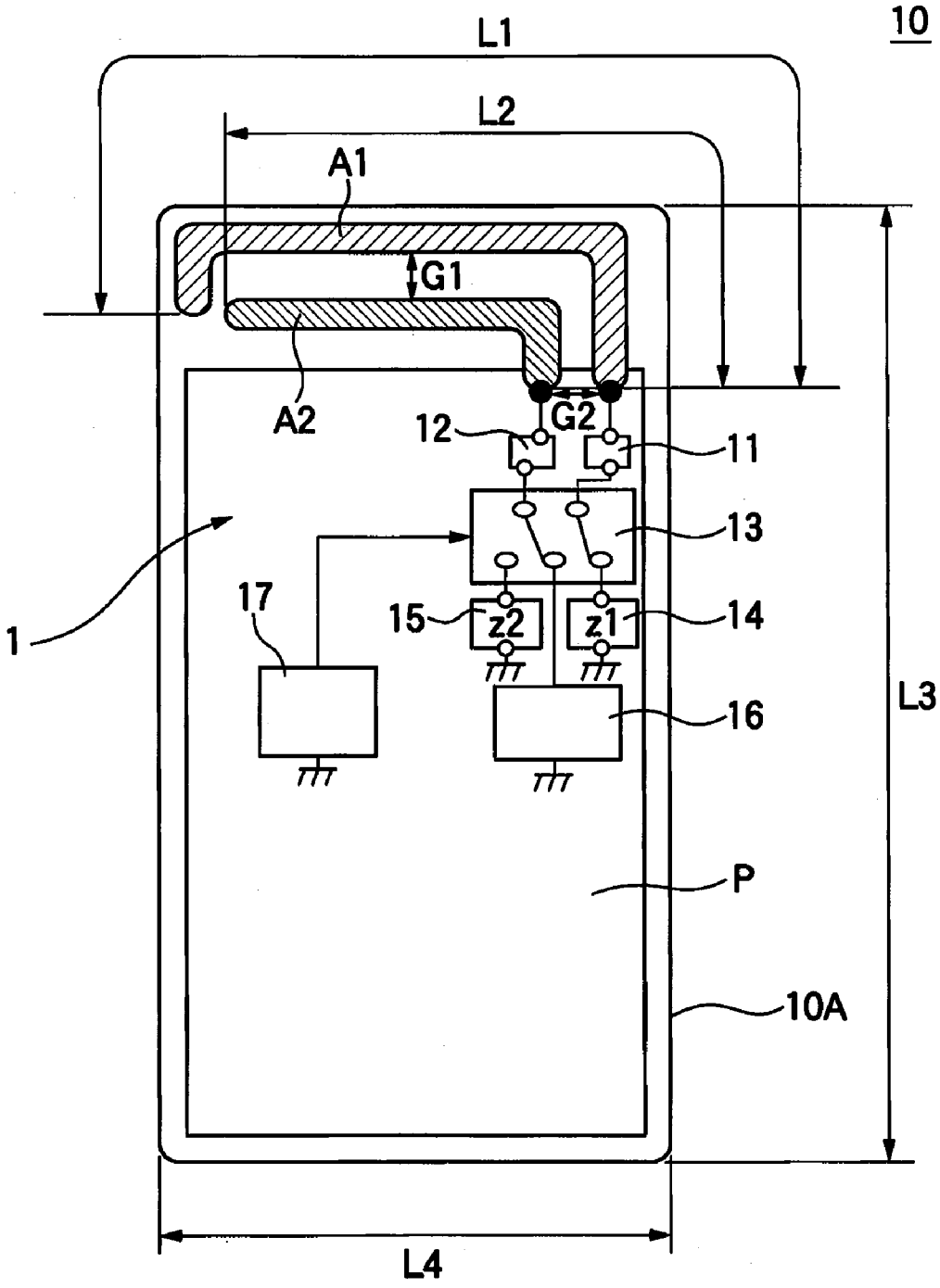
FIG. 1 is a schematic representation to show the configuration of a mobile telephone including an antenna device according to a first embodiment of the invention.

1, 2 Antenna device
10, 20 Mobile telephone (portable radio apparatus)
10A, 20A Cabinet
11, 12 Matching circuit
13 High-frequency switch (switch section)
14, 15 Reactance element
16 Wireless section (wireless circuit section)
25, 26, 27 Wireless section (first to third wireless circuit section)
17 Control section
21 Antenna share device
22, 23, 24 Filter (first to third filter)
A1, A2 Antenna (first antenna element, second antenna element)

P Circuit board

α, β, γ, δ, ϵ Function curve (VSWR characteristic)

BEST MODE FOR CARRYING OUT THE INVENTION

Embodiments of the invention will be discussed below in detail with reference to the accompanying drawings:

First Embodiment

Figure 2:
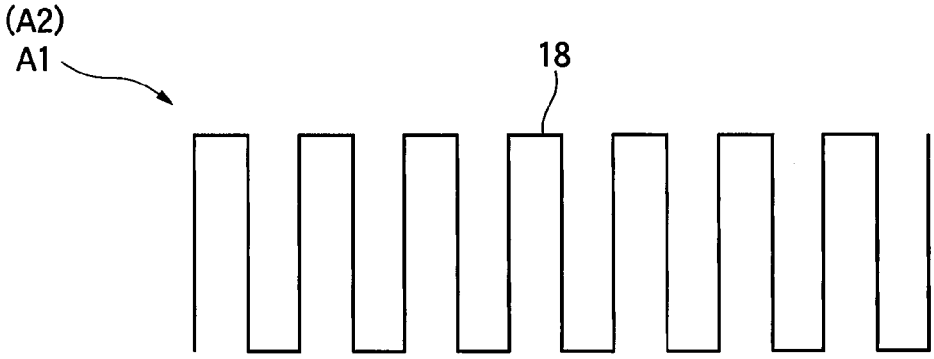
FIG. 2 is a schematic representation to show the shape of a meander of a typical configuration of an antenna element according to the first embodiment.
Figure 3:
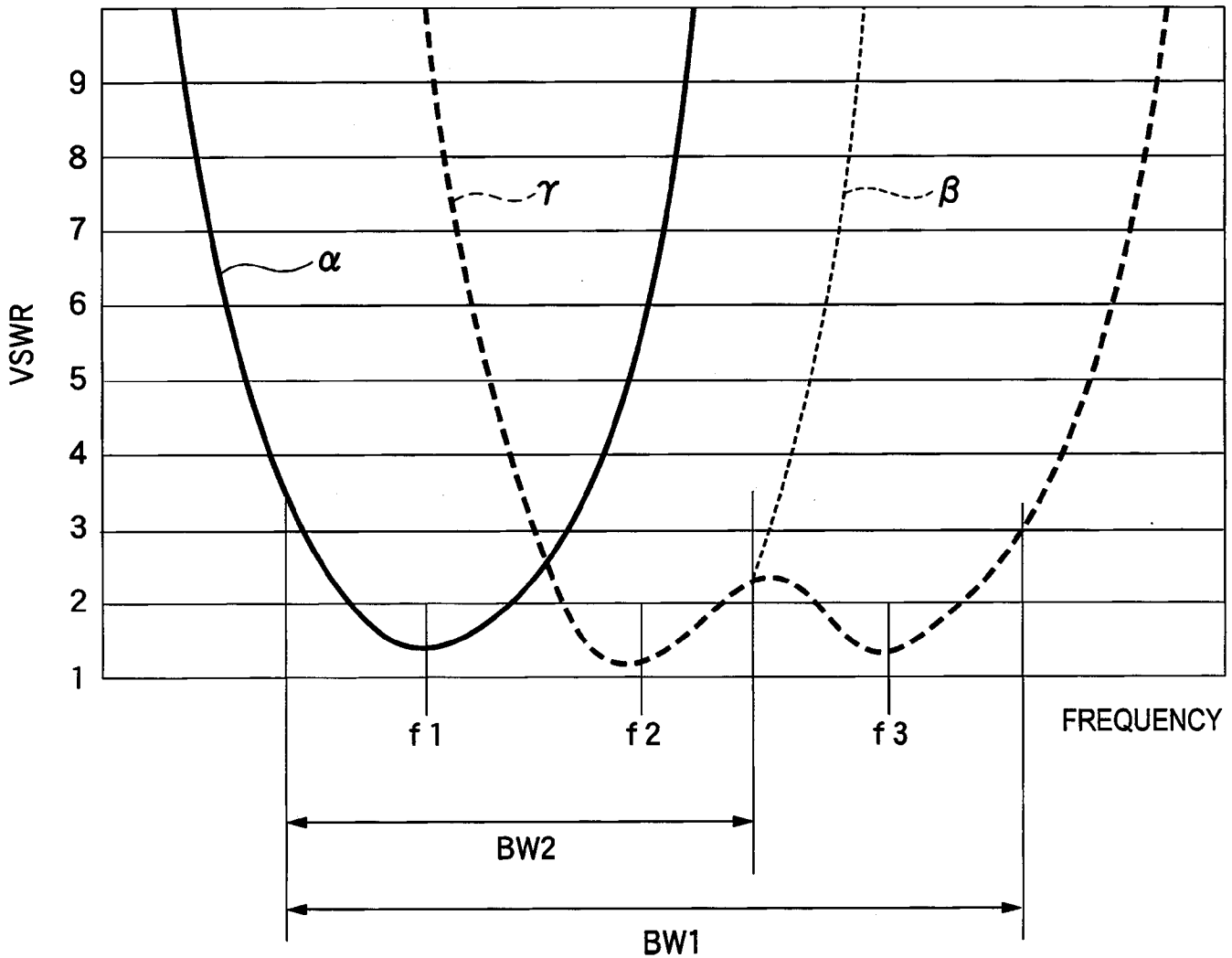
FIG. 3 is a graph to show the VSWR characteristic of the mobile telephone including the antenna device according to the first embodiment.

FIG. 1 is a drawing to show the configuration of a mobile telephone 10 of a portable radio apparatus including an antenna device 1 according to a first embodiment of the invention. FIG. 2 is a drawing to show the configuration of a meander-like element becoming a typical shape of an antenna element in the antenna device 1 according to the first embodiment of the invention. FIG. 3 is a drawing to show the VSWR (Voltage Standing Wave Ratio) characteristics of the antenna device 1 and the mobile telephone 10 including the antenna device 1 according to the first embodiment of the invention.

The antenna device 1 includes a function capable of receiving terrestrial digital broadcasting and terrestrial digital audio broadcasting (frequencies are about 470 MHz to 770 MHz). That is, in the antenna device 1, to use any other frequency band than the terrestrial digital broadcasting at the antenna, the antenna element length can be changed for use. The antenna device 1 can be used not only for reception only as in the embodiment, but also for a transmission or transmission-reception wireless communication system, of course, and a similar advantage can be expected.

In FIG. 1, an antenna A1 forming a first antenna element, an antenna A2 forming a second antenna element, a circuit board P, and the like are provided in a cabinet 10A of the mobile telephone 10 forming the portable radio apparatus of the invention.

The mobile telephone 10 includes both functions of a voice communication function and a digital TV broadcasting reception function. The cabinet 10A of the mobile telephone 10 is formed of a resin case having an overall length L3 of 140 mm and an overall width L4 of 50 mm.

The antenna A1 is formed of a meander-shaped metal plate as shown in FIG. 2 and is fitted and fixed to the cabinet 10A at the upper end of the mobile telephone 10, specifically an inner wall of the cabinet case. Although a length L1 of the antenna A1 is 70 mm, the antenna is shaped like a meander and thus the electric length (substantial electric length) is about 160 mm corresponding to a quarter-wavelength of the wavelength at 470 MHz (f1) of the lower limit of the digital TV broadcasting frequency. A first frequency band is about ±80 MHz with 470 MHz (f1) as the center.

One end of the antenna A1 is a spring structure formed by bending the element in FIG. 2 and the spring portion is electrically connected onto a print pattern of copper foil on the circuit board P and is also electrically connected to a matching circuit 11 described later.

Like the antenna A1, the antenna A2 is also formed of a meander-shaped metal plate 18 (see FIG. 2) and is fitted and fixed to the cabinet 10A (inner wall of the cabinet case) at a position with a 3-mm gap (G1) from the antenna A1. Although a length L2 of the antenna A2 is 45 mm, the antenna is shaped like a meander and thus the electric length (substantial electric length) is about 120 mm corresponding to a quarter-wavelength of the wavelength at 620 MHz (f2) of the center frequency of the digital TV broadcasting frequency. A second frequency band is about ±80 MHz with 620 MHz (f2) as the center.

As with the antenna A1, one end of the antenna A2 is a spring structure formed by bending the element and the spring portion is electrically connected onto a print pattern of copper foil on the circuit board P and is also electrically connected to a matching circuit 12 described later. The one end part of the antenna A2 and the one end part of the antenna A1 are spaced from each other with a gap (G2) of about 2 mm.

The circuit board P is a printed board installing circuit components for implementing various functions of the mobile telephone 10 of the embodiment; a ground pattern (not shown) becoming a ground potential of the circuit is formed on the roughly full face. Installed on the circuit board P are the antenna A1, the antenna A2, the matching circuits 11 and 12 to which the antennas are connected, a high-frequency switch 13, a first reactance element 14, a second reactance element 15, a wireless section 16, a control section 17, and the like.

The matching circuit 11 plays a role in matching impedance matching of the antenna A1 with the input impedance of the wireless section 16 (generally, 75Ω), and is connected to the high-frequency switch 13 (forming switch section) through a conductor pattern on the circuit board P.

Like the matching circuit 11, the matching circuit 12 plays a role in matching impedance matching of the antenna A2 with the input impedance of the wireless section 16 (generally, 75Ω), and is connected to the high-frequency switch 13 through a conductor pattern on the circuit board P.

The high-frequency switch 13 is connected to the wireless section 16 forming a wireless circuit section, the first reactance element 14, and the second reactance element 15 through a conductor pattern on the circuit board P, and electrically connects the matching circuit 11 and the first reactance element 14 or the wireless section 16 and the matching circuit 12 and the second reactance element 15 or the wireless section 16 according to a control signal from the control section 17.

The wireless section 16 forms a wireless circuit section and demodulates a reception signal received at the antenna A1 and the antenna A2.

Each of the first reactance element 14 and the second reactance element 15 is formed of a capacitive or inductive chip component and has one end part connected to the ground pattern of the circuit board P.

In the mobile telephone 10 according to embodiment as described above, if the antenna A1 is connected to the wireless section 16 through the matching circuit 11 by the operation of the high-frequency switch 13, the antenna A1 operates as a radiating element and VSWR characteristic (resonance frequency f1=470 MHz) of a function curve α shown in FIG. 3 is provided. The lower the VSWR value, the higher antenna performance; generally, if VSWR<3, good antenna performance can be ensured.

At this time, the antenna A2 is electrically connected to the ground pattern through the matching circuit 12 and the second reactance element 15. At the time, the reactance value of the second reactance element 15 is preset to an appropriate value so as to minimize the electromagnetic coupling degradation effect because of the proximity of the antenna A1 and the antenna A2. However, the antenna A1 can ensure high antenna performance in the proximity of resonance frequency f1=470 MHz in a state in which the proximity effect of the antenna A2 is lightened.

If the antenna A2 is connected to the wireless section 16 through the matching circuit 12 by the operation of the high-frequency switch 13, the antenna A2 operates as a radiating element and VSWR characteristic (resonance frequency f2=620 MHz) of a function curve β is provided. On the other hand, the antenna A1 is placed close to the antenna A2 of a radiating element and thus operates as a passive element of the antenna A2. Thus, VSWR characteristic of a function curve γ is provided from the radiating element and the passive element.

Generally, the resonance frequency of a passive element electrically opened at both ends resonates to about a half-wavelength of the antenna element length and thus becomes 940 MHz (f1=470 MHz×2) in the embodiment. On the other hand, the frequency band of the terrestrial digital broadcasting is 770 MHz (f3) at the maximum. Thus, to give the digital TV broadcasting reception function, it is necessary to lower the resonance frequency of the passive element.

Then, in the embodiment, as described above, if the antenna A2 is connected to the wireless section 16 by the operation of the high-frequency switch 13, at the same time, the antenna A1 is electrically connected to the ground pattern through the first reactance element 14. However, at the time, the reactance value of the first reactance element 14 is set so that the resonance frequency (f3) of the antenna A1 (operating as a passive element) is 770 MHz. A third frequency band is ±80 MHz with 770 MHz (f3) as the center.

However, in the embodiment, power is fed into the antenna A2, whereby the antenna A2 operates as a radiating element and the antenna A1 operates as a passive element and they act as 2-resonance antenna with resonance frequencies f2=620 MHz and f3=770 MHz. Thus, the frequency band width where high antenna performance can be ensured can be widened by utilizing the antenna A1 as the passive element.

Therefore, in the embodiment, a state in which power is fed into the antenna A1 and a state in which power is fed into the antenna A2 are switched, so that VSWR<3, the condition that good antenna performance is provided over a wide band from resonance frequency f1=470 MHz to f3=770 MHz, can be ensured as shown in FIG. 3 and high antenna performance can also be ensured in the TV broadcasting frequency band.

Thus, the mobile telephone 10 of the embodiment can cover the three frequency bands f1, f2, and f3 using the two antenna elements, so that a wide-band antenna system can be downsized and the design property and the operability are high.

Making a comparison between the embodiment and the case where two resonance frequencies are obtained simply using two antenna elements for making a wider band, in the latter, the frequency band widths of the antenna elements are widened and thus it is necessary to place the antenna elements and a ground pattern at a distance from each other and increase radiation resistance. Thus, it is necessary to place the antenna elements and the ground pattern further at an extra distance of about 5 mm from each other as compared with the former (the embodiment) and the antenna system is upsized.

Further, if the frequency is low and the wavelength is long, it is necessary to increase the distance from the ground pattern and metal components on the circuit board P, for example, hinge metal, a camera, a battery, a board pattern, etc., to make the radiation resistance high as compared with the case where the frequency is high and the wavelength is short, because the electric distance is determined by the wavelength ratio. Thus, in the embodiment, the antenna A1 where the resonance frequency is low (namely, the wavelength is long) is placed on the outside of the mobile telephone 10 relative to the antenna A2, so that high antenna performance can be ensured over a wide band.

Further, in the embodiment, to feed power into the antenna A1, degradation of antenna performance caused by lowering the radiation resistance because of the electromagnetic coupling effect that the antenna A2 is close to the antenna A1 is adjusted by the first reactance element 14. This means that the first reactance element 14 whose reactance value is appropriately selected is inserted between the antenna A2 and the ground pattern of the circuit board P, so that the frequency with the antenna A1 as a radiation source is prevented from being excited by the antenna A2, whereby the radiation resistance can be made high and high antenna performance can be ensured.

Further, in the embodiment, to feed power into the antenna A2, the reactance value of the second reactance element 15 is changed, whereby the resonance frequency of the antenna A1 operating as the passive element can be changed and antenna performance at any desired frequency can be improved.

In the embodiment, the antenna (A1, A2) is an element shaped like a meander, but the invention is not limited to it. A similar advantage can be provided if the antenna is a different antenna of a helical antenna, etc. Particularly, to apply to an antenna system different in operation frequency, a similar advantage can be provided even by a monopole antenna, etc., if resonance can be obtained.

In the embodiment, the distance (G2) between one end part of the antenna A2 and one end part of the antenna A1 is about 2 mm, but the invention is not limited to it. For example, if the distance (G2) is larger than 2 mm, the distance between the high-frequency switch 13 and at least one of the antenna A1 and the antenna A2 becomes longer, performance as much as the passage loss of a transmission line is degraded, and the advantage is a little impaired, but a similar advantage can be provided.

The antenna A1 and the antenna A2 are spaced from each other with the gap (G1) 3 mm, but the invention is not limited to it. For example, if the gap (G1) is equal to or less than a quarter-wavelength of the operation frequency of the antenna A2, an antenna current can be excited for the antenna A1 operating as the passive element and a similar advantage can be provided although the advantage involves a difference.

The embodiment is the mobile telephone 10 having the communication function as the portable radio apparatus, but the invention is not limited to it and a similar advantage can be provided if the apparatus is a portable radio apparatus of a terminal dedicated to broadcasting reception, etc.

The embodiment is the TV broadcasting reception antenna, but the invention is not limited to it; a similar advantage can also be provided in a transmission-reception wireless communication system.

Second Embodiment

Next, a second embodiment of the invention will be discussed. Parts identical with those of the first embodiment are denoted by the same reference numerals in the second embodiment and will not be discussed again.

Figure 4:
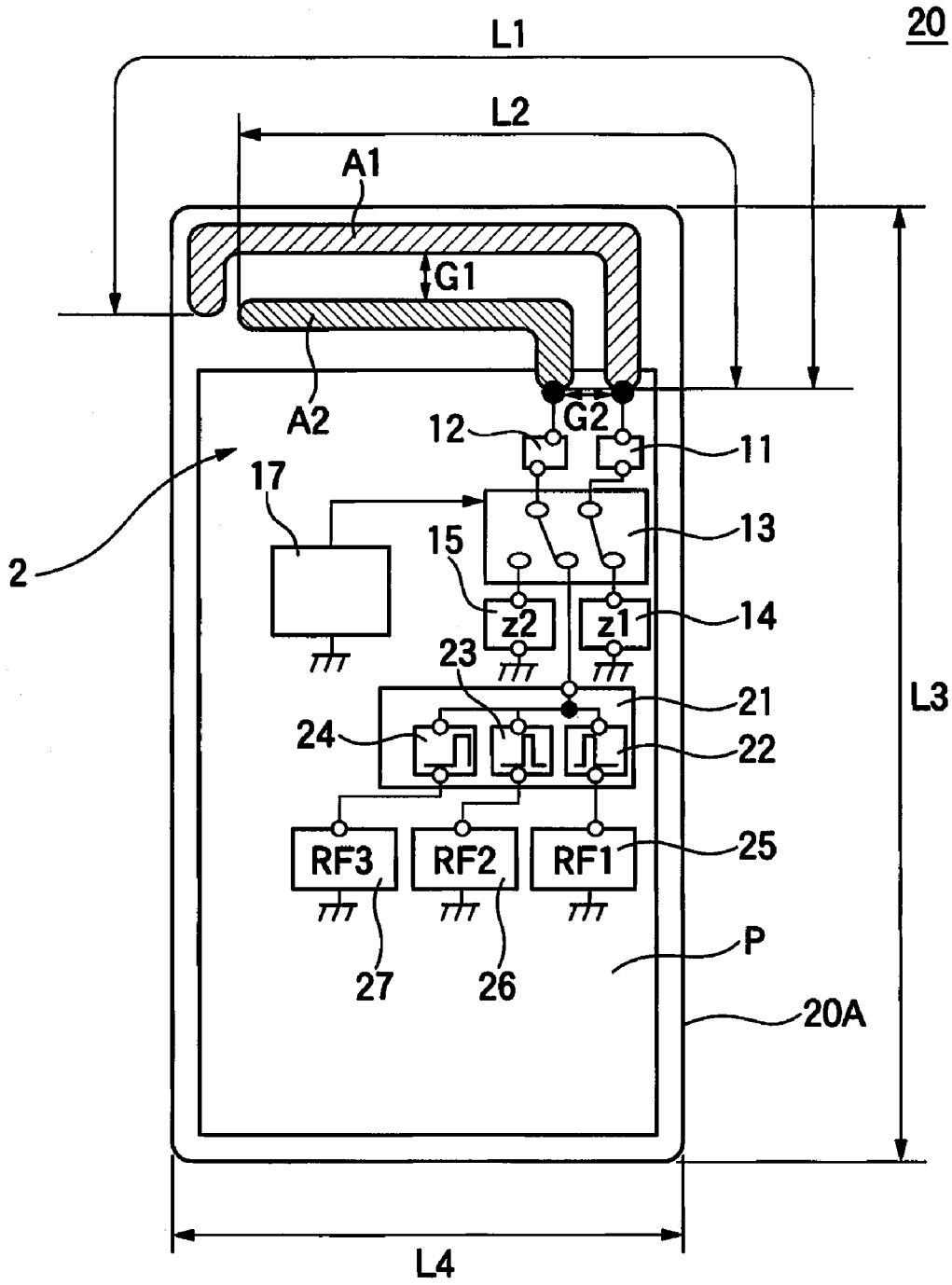
FIG. 4 is a schematic representation to show the configuration of a mobile telephone including an antenna device according to a second embodiment of the invention.
Figure 5:
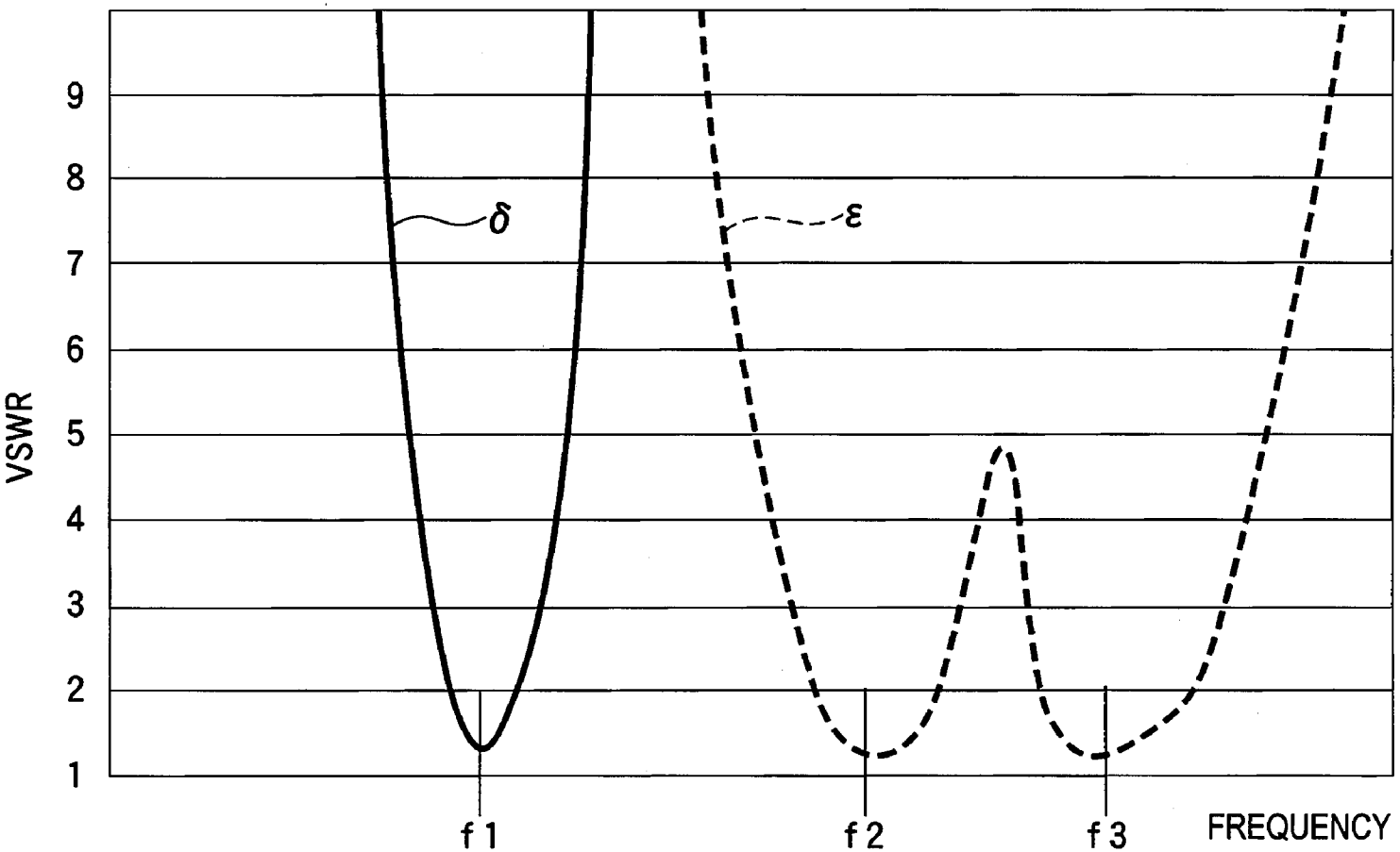
FIG. 5 is a graph to show the VSWR characteristic of the mobile telephone including the antenna device according to the second embodiment of the invention.

FIG. 4 is a drawing to show the configuration of a mobile telephone 20 of a portable radio apparatus including an antenna device 2 according to the second embodiment of the invention. FIG. 5 is a drawing to show the VSWR characteristics of the antenna device 2 according to the second embodiment of the invention.

The mobile telephone 20 according to the embodiment has a roughly similar configuration to that of the mobile telephone 10 described in the first embodiment; it differs from the mobile telephone 10 of the first embodiment in that it has two or more wireless sections different in frequency band, namely, three wireless sections (25, 26, and 27) forming a first wireless circuit section, a second wireless circuit section, and a third wireless circuit section and that the wireless sections (25, 26, and 27) are connected to a high-frequency switch 13 through an antenna share device 21.

The wireless section 25 covers communications at operation frequencies 830 MHz to 960 MHz, the wireless section 26 covers GPS reception in the proximity of 1575 MHz at operation frequency, and the wireless section 27 covers communications at operation frequencies 1920 to 2170 MHz.

An antenna A1 of the embodiment is formed of a linear metal plate having a length of about 8 cm corresponding to a quarter-wavelength of the wavelength when the frequency is 900 MHz.

On the other hand, an antenna A2 of the embodiment is also formed of a linear metal plate having a length of about 5 cm corresponding to a quarter-wavelength of the wavelength when the frequency is 1575 MHz.

In the antenna share device 21, a filter (forming a first filter) 22 for allowing the operation frequency of the wireless section (forming the first wireless circuit section) 25 to pass through and attenuating other frequency bands, a filter (forming a second filter) 23 for allowing the operation frequency of the wireless section (forming the second wireless circuit section) 26 to pass through and attenuating other frequency bands, and a filter (forming a third filter) 24 for allowing the operation frequency of the wireless section (forming the third wireless circuit section) 27 to pass through and attenuating other frequency bands are placed and are connected to the high-frequency switch 13.

The filter 22 is electrically connected to the wireless section 25 through a print pattern on a circuit board P. On the other hand, the filter 23 is electrically connected to the wireless section 26 through the print pattern on the circuit board P. The filter 24 is electrically connected to the wireless section 27 through the print pattern on the circuit board P.

In the mobile telephone 20 as described above, a control section 17 operates the wireless section 25. That is, the high-frequency switch 13 operates under the control of the control section 17 and the antenna A1 and the wireless section 25 are electrically connected through a matching circuit 11 and the antenna share device 21.

Accordingly, the antenna A1 operates as a radiating element and VSWR characteristic (resonance frequency f1=900 MHz) of a function curve 8 shown in FIG. 5 is provided. At this time, the antenna A2 is electrically connected to a ground pattern through a matching circuit 12 and a second reactance element 15. At the time, the reactance value of the second reactance element 15 is preset so as to minimize the electromagnetic coupling degradation effect because of the proximity of the antenna A1 and the antenna A2. However, the antenna A1 can ensure high antenna performance in the proximity of resonance frequency f1=900 MHz in a state in which the proximity effect of the antenna A2 is lightened.

If the control section 17 operates the wireless section 26, the high-frequency switch 13 electrically connects the antenna A2 and the wireless section 26 through the matching circuit 12 and the antenna share device 21 under the control of the control section 17.

Accordingly, the antenna A2 operates as a radiating element and VSWR characteristic (resonance frequency f2=1575 MHz) of a function curve E shown in FIG. 5 is provided. The antenna A1 is placed close to the antenna A2 of a radiating element and thus operates as a passive element of the antenna A2. Thus, the VSWR characteristic of the function curve E is provided from the radiating element and the passive element.

As also described in the first embodiment, the resonance frequency of a passive element electrically opened at both ends generally resonates to about a half-wavelength of the antenna element length. Thus, the resonance frequency becomes f3=1800 MHz (f1=900 MHz×2) in the embodiment. However, the operation frequency in the wireless section 27 is 1920 MHz to 2170 MHz and thus the resonance frequency of the passive element needs to be increased.

Then, in the embodiment, if the antenna A2 is connected to the antenna share device 21 by the operation of the high-frequency switch 13 the high-frequency switch 13, at the same time, the antenna A1 is electrically connected to the ground pattern through a first reactance element 14. At the time, the reactance value of the first reactance element 14 is set so that the resonance frequency f3 of the antenna A1 operating as the passive element is 2000 MHz.

For adjustment to thus increase the frequency, the reactance value is capacitive. However, power is fed into the antenna A2, whereby the antenna A2 operates as the radiating element and the antenna A1 operates as the passive element and they act as 2-resonance antenna with resonance frequencies f2=1575 MHz and f3=2000 MHz.

Thus, in the embodiment, the frequency band width where high antenna performance can be ensured can be widened by utilizing the antenna A1 as the passive element. Therefore, a state in which power is fed into the antenna A1 and a state in which power is fed into the antenna A2 are switched, so that VSWR<3 can be ensured and high antenna performance can be ensured in the operation frequency of each of the wireless section 25, the wireless section 26, and the wireless section 27 as shown in FIG. 5.

Thus, the mobile telephone 20 of the embodiment can cover the three frequency bands using the two antenna elements, an antenna system compatible with a plurality of wireless applications can be downsized, and the design property and the operability can be enhanced.

Further, the wireless section 26 and the wireless section 27 are connected to the antenna A2 through the antenna share device 21 and thus can operate at the same time and the convenience of the user can be improved.

Further, for example, if different antenna performance is demanded for the wireless section 25, the wireless section 26, and the wireless section 27, the antenna performance can be adjusted by adjusting a gap (G1) between the antenna A1 and the antenna A2. That is, to enhance the antenna performance of the wireless section 27 having the highest operation frequency, the gap (G1) may be lessened so as to excite much an antenna current for the antenna A1 operating as the passive element.

In the embodiment, the antenna (A1, A2) is a linear element, but the invention is not limited to it. A similar advantage can be provided if the antenna is a different antenna of a helical antenna, a meander antenna, etc.

In the embodiment, the distance (G2) between one end part of the antenna A2 and one end part of the antenna A1 is about 2 mm, but the invention is not limited to it. For example, if the distance (G2) is larger than 2 mm, the distance between the high-frequency switch 13 and at least one of the antenna A1 and the antenna A2 becomes longer, performance as much as the passage loss of a transmission line is degraded, and the advantage is a little impaired, but a similar advantage can be provided.

The antenna A1 and the antenna A2 are spaced from each other with the gap (G1) 3 mm, but the invention is not limited to it. For example, if the gap (G1) is equal to or less than a quarter-wavelength of the operation frequency of the antenna A2, an antenna current can be excited for the antenna A1 operating as the passive element and a similar advantage can be provided although the advantage involves a difference.

The embodiment is also the mobile telephone 20 having the communication function, but the invention is not limited to it and a similar advantage can be provided if the apparatus is a portable radio apparatus of a terminal dedicated to broadcasting reception, etc.

While the invention has been described in detail with reference to the specific embodiments, it will be obvious to those skilled in the art that various changes and modifications can be made without departing from the spirit and the scope of the invention.

INDUSTRIAL APPLICABILITY

The antenna device of the invention has the advantage that it can be downsized and can ensure high antenna performance in a wide frequency band without impairing the design property or the operability, and can be applied to a portable radio apparatus that can receive TV broadcasting and conduct wireless communications.

The invention claimed is:

1. An antenna device, comprising:

a first antenna element that has a resonance characteristic in a first frequency;

a second antenna element that has a resonance characteristic in a second frequency and is spaced from the first antenna element at a predetermined distance;

a wireless circuit section that supplies or receives high-frequency power; and a switch section that selectively connects an output terminal or an input terminal of the wireless circuit section and a feeding point of the first antenna element or the second antenna element, so as to switch and connect the wireless circuit section and either one of the first antenna element and the second antenna element, wherein the second antenna element has an antenna effective length made shorter than an antenna effective length of the first antenna element, and when the switch section connects the wireless circuit section and the feeding point of the second antenna element and power is transmitted or received from the second antenna, the first antenna element operates as a passive element of the second antenna element, whereby the frequency characteristic of the second antenna element has a resonance characteristic in a vicinity of the second frequency and a third frequency higher than the second frequency.

2. The antenna device according to claim 1, wherein the length of the first antenna element is about a quarter-wavelength of the first frequency; and wherein the length of the second antenna element is about a quarter-wavelength of the second frequency.

3. The antenna device according to claim 1, wherein the length of the first antenna element is about a half-wavelength of the third frequency.

4. The antenna device according to claim 1, wherein the gap between the first antenna element and the second antenna element is equal to or less than about a quarter-wavelength of the second frequency.

5. The antenna device according to claim 1, wherein the first antenna element is disposed on an end part side in the portable radio apparatus from the second antenna element.

6. The antenna device according to claim 1, further comprising:

a circuit board; and a first reactance element disposed between the switch section provided on the circuit board and a ground pattern of the circuit board, wherein when the first antenna element is connected to the wireless circuit section through the switch section, the second antenna element is connected to the ground pattern of the circuit board through the switch section and the first reactance element.

7. The antenna device according to claim 1, further comprising:

a circuit board; and a second reactance element disposed between the switch section provided on the circuit board and a ground pattern of the circuit board, wherein when the second antenna element is connected to the wireless circuit section, the first antenna element is connected to the ground pattern of the circuit board through the second reactance element.

8. The antenna device according to claim 1, wherein a distance between an end part on the switch section side of the first antenna element and an end part on the switch section side of the second antenna element is within a one-eighth wavelength of the second frequency.

9. A portable radio apparatus having the antenna device according to claim 1.

10. An antenna device, comprising:

a first antenna element that has a resonance characteristic in a first frequency;

a second antenna element that has a resonance characteristic in a second frequency and is spaced from the first antenna element at a predetermined distance;

a first wireless circuit section;

a second wireless circuit section having an operation frequency higher than an operation frequency of the first wireless circuit section;

a third wireless circuit section having an operation frequency higher than the operation frequency of the second wireless circuit section;

a switch section that effectively and selectively connects an output terminal or an input terminal of the first wireless circuit section, the second wireless circuit section, or the third wireless circuit section and a feeding point of the first antenna element or the second antenna element, so as to switch and connect the first, second, or third wireless circuit section and either one of the first antenna element and the second antenna element;

a first filter, provided between the switch section and the first wireless circuit section, for attenuating a signal other than the operation frequency of the first wireless circuit section;

a second filter, provided between the switch section and the second wireless circuit section, for attenuating a signal other than the operation frequency of the second wireless circuit section; and a third filter, provided between the switch section and the third wireless circuit section, for attenuating a signal other than the operation frequency of the third wireless circuit section, wherein the second antenna element has an antenna effective length made shorter than an antenna effective length of the first antenna element, and when the switch section connects the first, second, or third wireless circuit section and the feeding point of the second antenna element and power is transmitted or received from the second antenna, the first antenna element operates as a passive element of the second antenna element, whereby the frequency characteristic of the second antenna element has a resonance characteristic in a vicinity of the second frequency and a third frequency higher than the second frequency.

* * * * *